US006543313B2

(12) United States Patent
Samudosky

(10) Patent No.: US 6,543,313 B2
(45) Date of Patent: Apr. 8, 2003

(54) POWERED WRENCH

(76) Inventor: Vincent M. Samudosky, 2647 Campbell Cir., West Mifflin, PA (US) 15122

( * ) Notice: Subject to any disclaimer, the term of this patent is extended or adjusted under 35 U.S.C. 154(b) by 0 days.

(21) Appl. No.: 09/875,732

(22) Filed: Jun. 7, 2001

(65) Prior Publication Data

US 2002/0184974 A1 Dec. 12, 2002

(51) Int. Cl.[7] ..... B25B 17/00

(52) U.S. Cl. ..... 81/57.29; 81/57.17; 81/57.43; 81/177.2

(58) Field of Search ..... 81/57, 57.11–57.14, 81/57.27–57.31, 57.17, 57.19, 57.42–57.44, 177.6, 177.2, 900

(56) References Cited

U.S. PATENT DOCUMENTS

| | | | | | |
|---|---|---|---|---|---|
| 2,353,642 | A | * | 7/1944 | Buice | 81/57.17 |
| 3,602,071 | A | * | 8/1971 | Juhasz | 81/57.14 |
| 4,604,922 | A | * | 8/1986 | Soutsos | 81/57.17 |
| 4,730,960 | A | * | 3/1988 | Lewis et al. | 81/177.6 |
| 5,351,582 | A | * | 10/1994 | Snyder et al. | 81/57.17 |
| 5,782,149 | A | * | 7/1998 | Jensen | 81/900 |

* cited by examiner

*Primary Examiner*—D. S. Meislin
(74) *Attorney, Agent, or Firm*—Donald R. Schoonover

(57) ABSTRACT

A powered wrench includes a chain that is driven by a fluid motor. The chain engages a workpiece and rotates that workpiece in response to operation of the fluid motor. The fluid motor can be located spaced from the handle of the wrench or in the handle of the wrench. An extension can also be included to extend the reach of the wrench.

3 Claims, 4 Drawing Sheets

POWERED WRENCH

BACKGROUND OF THE INVENTION

1. Field of the Invention

The present invention relates to the general art of tools, and to the particular field of wrenches.

2. Discussion of the Related Art

Many businesses, such as automobile repair shops, routinely encounter workpieces, such as bolts, nuts or the like, that are extremely difficult to remove or place. The difficulty can be a result of the workpiece being fixed, as by rust or the like, in place, or because the workpiece is in a location that is very difficult to reach. For example, a bolt may be underneath another part that blocks access to the bolt or inhibits movement of a wrench or tool used to move the workpiece in a manner necessary to the operation. This makes removal or installation of certain workpieces difficult and time consuming.

It is often necessary to remove other parts to gain access to the workpiece of interest with a wrench, such as an open-ended wrench or a box wrench or the like.

Therefore, there is a need for a wrench that can expeditiously reach and remove workpieces that are located in difficult to reach locations.

While the tool art contains many examples of powered wrenches, the inventor is not aware of any powered wrench which is easily adapted to reaching hard to reach elements. Most of the known powered wrenches are cumbersome and are not amenable to use on a workpiece to which frontal access is blocked and/or side access to that workpiece is severely restricted.

Therefore, there is a need for a powered wrench that can expeditiously reach workpieces to which access is severely limited.

Still further, many of the known powered wrenches are not easily adapted to a wide range of workpiece sizes. A workpiece-engaging head must be sized for each particular workpiece and must be changed each time the wrench is used with a different size or shape workpiece.

Therefore, there is a need for a powered wrench that can easily accommodate a range of workpiece sizes and shapes without requiring changing of the workpiece-engaging portion of the wrench.

Even when the known powered wrenches can be used on a workpiece, the workpiece-engaging portion of the powered wrench must be carefully and accurately oriented to accommodate the workpiece. While many known powered wrenches are designed to make such an accommodation, still further improvement in this feature is required to expedite use of a powered wrench.

Therefore, there is a need for a powered wrench that can accommodate connection to a workpiece in an expeditious manner.

For various reasons it may be necessary to be able to quickly disable a powered wrench. Other than turning a motor off, many known powered wrenches cannot be easily disabled.

Therefore, there is a need for a powered wrench that can be easily disabled and has a plurality of means for disabling the powered wrench.

PRINCIPAL OBJECTS OF THE INVENTION

It is a main object of the present invention to provide a wrench that can expeditiously reach and remove workpieces that are located in difficult to reach locations.

It is another object of the invention to provide a powered wrench that can expeditiously reach workpieces to which access is severely limited.

It is another object of the present invention to provide a powered wrench that can easily accommodate a range of workpiece sizes and shapes without requiring changing of the workpiece-engaging portion of the wrench.

It is another object of the present invention to provide a powered wrench that can accommodate connection to a workpiece in an expeditious manner.

It is another object of the present invention to provide a powered wrench that can be easily disabled and has a plurality of means for disabling the powered wrench.

SUMMARY OF THE INVENTION

These, and other, objects are achieved by a powered wrench that has a workpiece-engaging driven chain in the workpiece engaging portion thereof. The chain is driven by a fluid motor. One form of the powered wrench of the present invention includes an open-ended head and another form of the wrench includes a box head. Yet another form of the wrench includes an extension that can include a flexible section and yet another form of the powered wrench of the present invention includes a fluid motor in the handle of the wrench.

The workpiece-engaging chain of the present invention permits a powered wrench to expeditiously reach and remove workpieces that are located in difficult to reach locations, even when access to the workpiece is severely limited. The chain is flexible so the powered wrench can easily accommodate a range of workpiece sizes and shapes without requiring changing of the workpiece-engaging portion of the wrench and accommodates connection to a workpiece in an expeditious manner.

The powered wrench of the present invention also has a sprocket that drives the chain by rotation thereof, and a ratchet and pawl mechanism that can prevent rotation of the chain-driving sprocket when activated. Thus, in addition to simply disabling the motor driving the powered wrench, there is an additional means for stopping operation of the powered wrench.

DETAILED DESCRIPTION OF THE INVENTION

Other objects, features and advantages of the invention will become apparent from a consideration of the following detailed description and the accompanying drawings.

Figures 1, 2, 3:
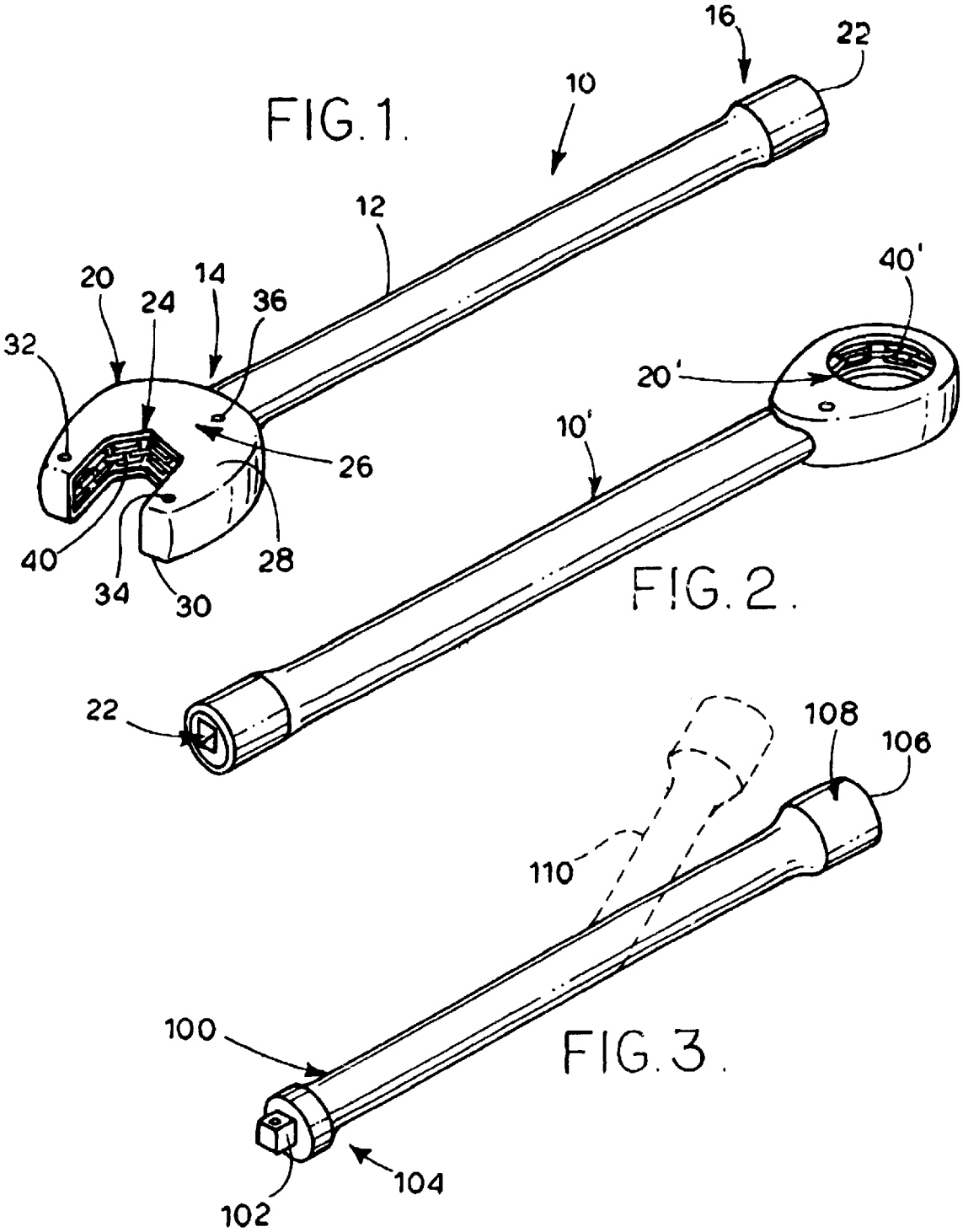
FIG. 1 is a distal end and top perspective view of an open-ended powered wrench embodying the teaching of the present invention.
FIG. 2 is a proximal end and top perspective view of a box powered wrench embodying the teaching of the present invention.
FIG. 3 is a perspective view of an extension for use with the powered wrench of the present invention.
Figure 4:
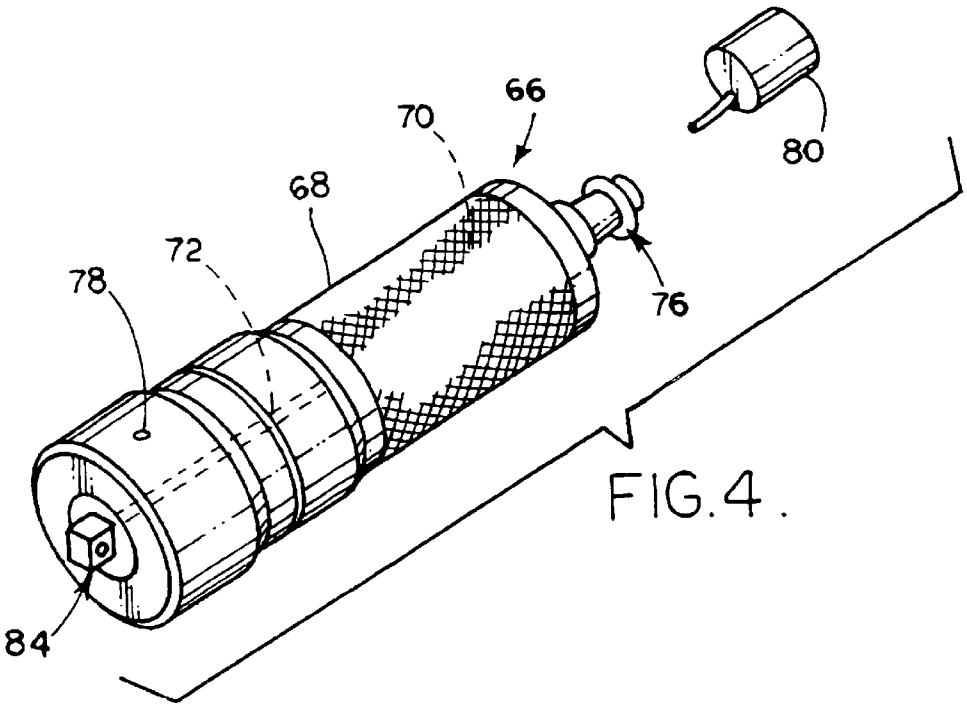
FIG. 4 is an end perspective view of a fluid motor that is used in the powered wrench of the present invention.

Shown in FIGS. 1, 2 and 4 is a powered wrench 10 that can easily reach and accommodate workpieces that are located in difficult to reach areas and can accommodate a range of workpiece sizes and shapes because the powered wrench uses a chain to operate the workpiece.

Figure 8:
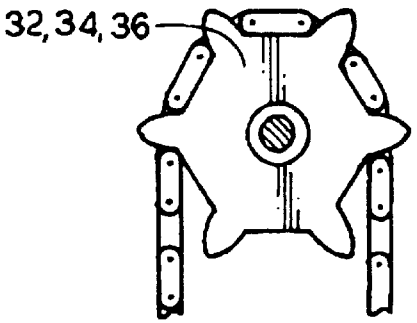
FIG. 8 shows a sprocket engaging a chain to either guide or drive the chain in accordance with the teaching of the present invention.

As shown in FIGS. 1, 2 and 4, powered wrench 10 is an open-ended wrench and comprises a hollow handle 12 having a distal end 14 and a proximal end 16 with a hollow bore (not visible in the figures) extending from proximal end 14 to distal end 16. Wrench 10 further comprises a workpiece-engaging head 20 on distal end 14 of handle 12. A mechanical connector 22 is located on proximal end 16 of handle 12. A workpiece-engaging mechanism 24 located in workpiece engaging head 20 of handle 12 and includes a magnet 26 which is preferably formed of top plate 28 and bottom plate 30 and is formed of magnetic material suitable for use in a powered wrench. Workpiece-engaging mechanism 24 includes two chain-guiding sprockets 32 and 34 and a chain-driving sprocket 36. An example of sprockets 32, 34 and 36 is shown in FIG. 8.

A chain 40 engages chain-driving sprocket 36 and the two chain-guiding sprockets 32 and 34 and is oriented to have one side thereof located to engage a workpiece positioned in workpiece-engaging head 20.

Figure 9:
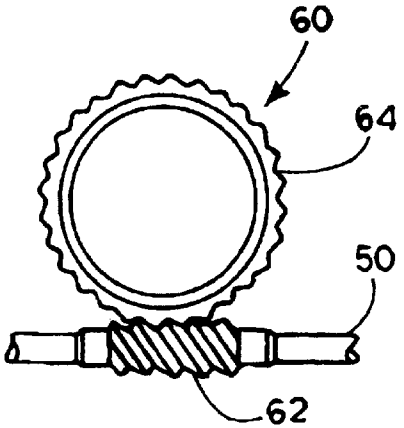
FIG. 9 shows a drive connection for connecting a fluid motor output to a chain drive sprocket in accordance with the teaching of the present invention.

Powered wrench 10 also includes a chain-driving mechanism which is shown in FIGS. 1, 2, 4 and 5 and includes a drive shaft 50 located inside hollow handle 12 and which is drivingly connected at one end thereof to chain-driving sprocket 36 of workpiece-engaging mechanism 24 and has another end thereof drivingly connected to mechanical connector 22 for operation therewith. The end of drive shaft 50 drivingly connected to chain-driving sprocket 36 includes a suitable gear connection for translating rotation of shaft 50 into sprocket-driving motion. One such connection is a worm and worm gear having non-intersecting axes with a cylindrical worm such as shown in FIG. 9 as gear connection 60 with gear 62 being on shaft 50 and gear 64 being either connected to or actually being chain-driving sprocket 36. Other suitable connections between shaft 50 and chain-driving sprocket 36 will be envisioned by those skilled in the gearing art based on the teaching of the present invention.

Figure 6:
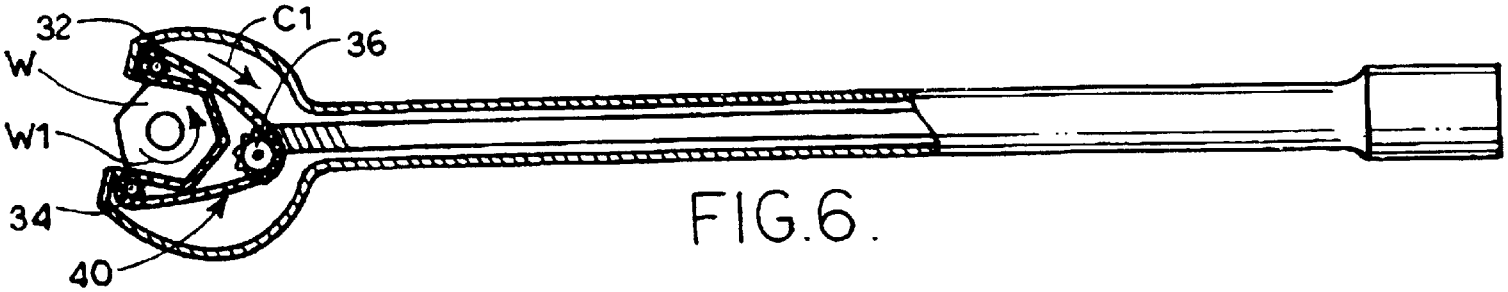
FIG. 6 shows an open-ended wrench form of the powered wrench of the present invention engaging a workpiece, such as a bolt; portions are cut away to reveal details thereof.

Chain 40 is driven around sprockets 32 and 34 by operation of sprocket 36. As chain 40 moves, it will turn a workpiece W engaged therewith in direction W1 when chain 40 moves in direction C1 as indicated in FIG. 6 under the influence of drive sprocket 36. Drive sprocket 36 is driven by shaft 50 which is driven by a fluid drive mechanism 66 shown in FIG. 4. Fluid drive mechanism 66 includes a housing 68, a fluid motor 70 located in housing 68 of fluid drive mechanism 66. Fluid drive motor 70 is of the type that includes rotors that are rotated when fluid, such as oil, water or even air, is directed thereagainst. Those skilled in the motor art will understand what type of fluid motor is best suited to use with the powered wrench of the present invention and thus details of such fluid motor will not be presented here. Fluid drive mechanism 66 includes an output shaft 72 which rotates when fluid flows through the fluid motor, and a fluid inlet port 76 defined in housing 68 of fluid drive mechanism 66 and is fluidically connected to fluid motor 70 of fluid drive mechanism 66. Fluid drive mechanism 66 further includes a fluid outlet port 78 defined in housing 68 of fluid drive mechanism 66 and is spaced from inlet port 76 and is fluidically connected to fluid motor 70 whereby fluid flowing from a fluid source 80 into inlet port 76 will flow through fluid motor 70 as the fluid flows from inlet port 76 to outlet port 78 of fluid drive mechanism 66.

As fluid flows through the fluid motor, the output shaft 72 thereof is rotated. Rotation of drive shaft 50 is translated into rotation of chain-driving sprocket 36 by a mechanism such as shown in FIG. 9, and rotation of output shaft 72 is connected to drive shaft 50 by a connector element 84 on output shaft 72 of fluid motor 70 which transfers rotation of the output shaft of the fluid motor to mechanical connector 22 on handle 12 when connector element 84 of fluid drive mechanism 66 is connected to mechanical connector 22 on handle 12 whereby rotation of output shaft 72 of the fluid motor is transferred to chain 40 of workpiece-engaging mechanism 20 via the connection between connector element 84 on output shaft 72 of the fluid motor, mechanical connector 22 on handle 12, drive shaft 50 of the chain-driving mechanism and chain-driving sprocket 36 of workpiece engaging mechanism 20.

Figure 7:
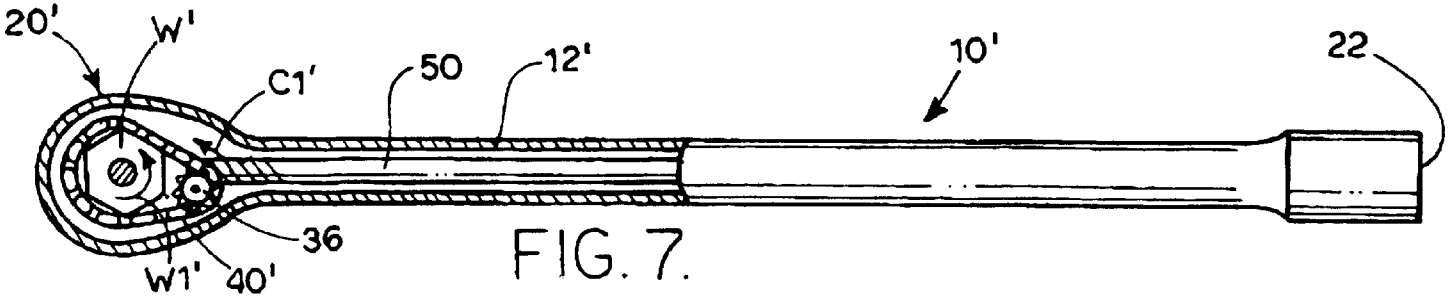
FIG. 7 shows a box wrench form of the powered wrench of the present invention engaging a workpiece, such as a bolt; portions are cut away to reveal details thereof.
Figure 13:
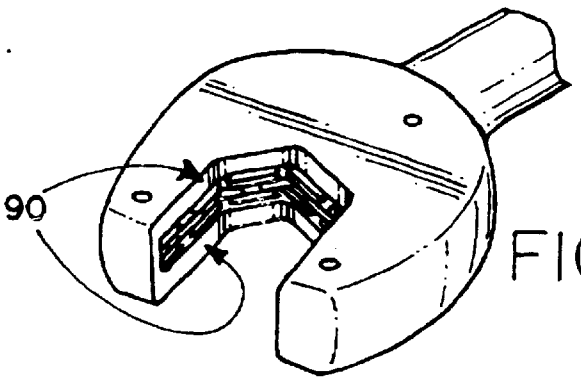
FIG. 13 shows a workpiece-engaging head of the powered wrench of the present invention with a lip thereon partially covering the workpiece-engaging chain.

As discussed above, the powered wrench of the present invention can be an open-ended wrench such as shown in FIG. 1 or a box wrench 10' such as shown in FIG. 2. Operation of box wrench 10' is identical to the operation of open-ended wrench 10 and thus will not be discussed. It is noted that chain 40' in head 20' of box wrench 10' encircles a workpiece W' such as shown in FIG. 7 and drives that workpiece in direction W1' when chain 40' moves in direction C1' under the influence of drive sprocket 36 as driven by drive shaft 50 from driving mechanism 66 connected to mechanical connector 22 on handle 12' of wrench 10' in the manner discussed above. Chain 40', like chain 40, accommodates a wide range of workpiece sizes and shapes because the chain is flexible and engages the workpiece with the links thereof. Chain 40' is guided by chain-guiding sprockets or by chain guides in workpiece-engaging mechanism 20'. A lip, such as lip 90 shown in FIG. 13 can be positioned on mechanism 20 or on mechanism 20' to control movement of the chain.

As discussed above, some workpieces may be located in difficult to reach positions. In fact, some workpieces may not be readily reached using handle 12. In such instances, the powered wrench of the present invention includes an extension 100 shown in FIG. 3. Referring to FIG. 3, extension 100 includes a first connecting element 102 on a distal end 104 thereof which is sized and shaped to drivingly engage mechanical connector 22 on handle 12 of either wrench 10 or 10', and a second connecting element 106 on a proximal end 108 thereof which is sized and shaped to drivingly connect to connector element 84 on the output shaft of the fluid motor of chain-driving mechanism 66 whereby rotation of the output shaft of the fluid motor is transferred to mechanical connector 22 on handle 12 via extension 100.

Figure 11:
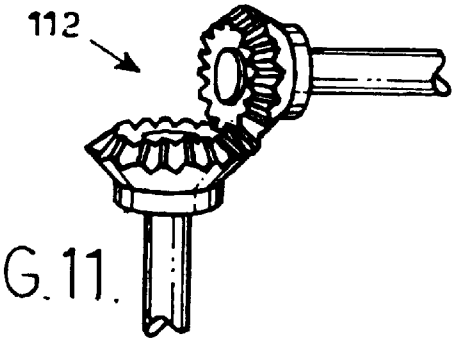
FIG. 11 shows a driving connection that can be used in an extension that can be oriented at an angle with respect to the workpiece-engaging head of the powered wrench of the present invention.

In some situations, the workpiece is so inaccessible that even the extension 100 may have to be modified to reach the workpiece. In such situations, an extension can include a flexible section, such as flexible section 110 positioned between the proximal end 108 and the distal end 104 of the extension so the extension can be deformed to accommodate the location of the workpiece. In such a situation, the extension has a flexible coupling located therein so rotation from the fluid motor can be transferred to connector 22. One form of such a flexible connection includes gearing such as bevel gears 112 shown in FIG. 11. Other forms of such offset and/or flexible coupling which transfers rotation will be evident to those skilled in the art and thus will not be discussed.

Figure 5:
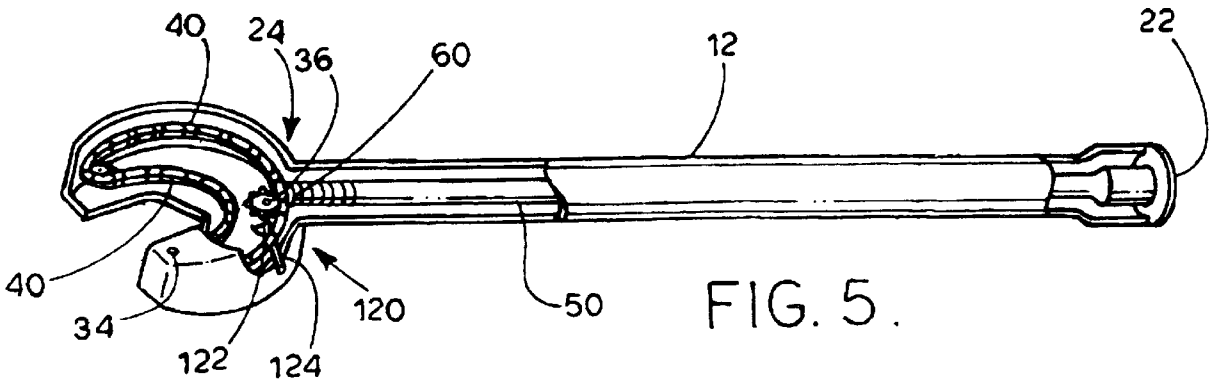
FIG. 5 shows an open-ended powered wrench of the present invention with a mechanism for stopping the operation of a chain of the wrench; portions are cut away to reveal details thereof.
Figure 10:
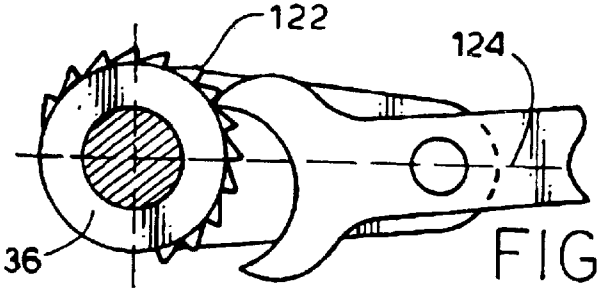
FIG. 10 shows a ratchet and pawl mechanism for stopping rotation of a chain-driving sprocket in accordance with the teaching of the present invention.

As discussed above, in some situations it is desirable to provide a plurality of mechanisms to stop operation of the powered wrench. As was also mentioned above, one mechanism is to simply deactivate the powering motor, such as motor 70. The powered wrench of the present invention provides an additional mechanism to stop operation of the chain. A chain-movement control mechanism 120 is shown in FIG. 5. Referring to FIG. 5, chain-movement control mechanism 120 is located on the workpiece-engaging head and includes a ratchet 122 on the chain-driving sprocket of the workpiece-engaging mechanism and a pawl 124 movably mounted on the workpiece-engaging head to move between a first position spaced from engagement with the chain-driving sprocket and a second position engaging the chain-driving sprocket with rotation of the chain-driving sprocket being prevented when the pawl is in the second position. One form of this mechanism is shown in FIG. 10; however, other forms of such chain movement-control mechanism will occur to those skilled in the art based on the teaching of the present disclosure. In the event that the ratchet and pawl mechanism is used to stop rotation of the chain-driving sprocket, an overrunning clutch may be included so the gears, and or chain are not damaged by stopping the chain using this mechanism.

Figure 12:
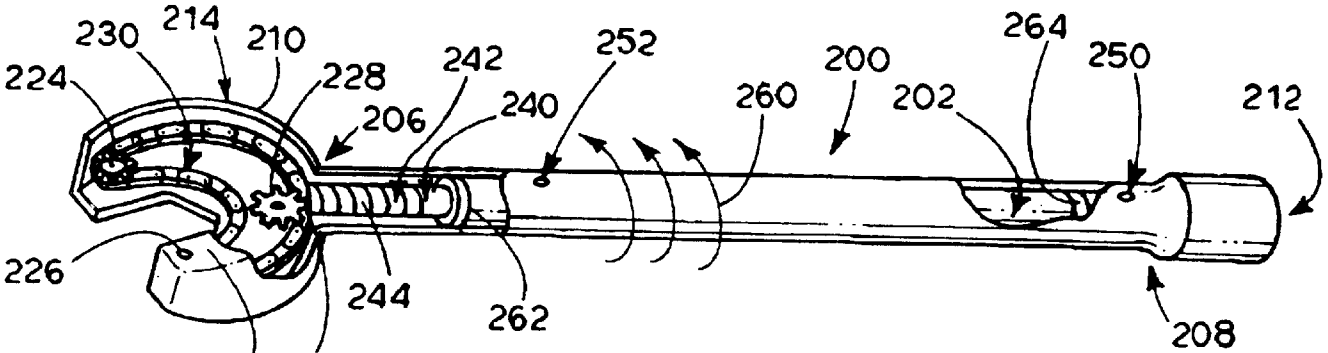
FIG. 12 shows a form of the powered wrench of the present invention having a fluid motor located in the handle of the wrench; portions are cut away to reveal details thereof.

Another form of the powered wrench of the present invention is shown in FIG. 12 as wrench 200. Referring to FIG. 12, wrench 200 has a fluid motor 202 located inside handle 204 instead of outside the handle as is the case with the powered wrench discussed above.

Accordingly, powered wrench 200 comprises a hollow handle 204 having a distal end 206 and a proximal end 208 with a workpiece-engaging head 210 on the distal end of handle 204. A mechanical connector 212 is located on the proximal end of handle 204 for connection to extension 100 and a workpiece-engaging mechanism 214 is located in the workpiece engaging head of handle 204. The workpiece-engaging mechanism includes a magnet 220 which can be the entire head as discussed above, two chain-guiding sprockets 224 and 226, a chain-driving sprocket 228, and a chain 230 engaging the chain-driving sprocket and the two chain-guiding sprockets and having one side thereof located to engage a workpiece positioned in workpiece-engaging head.

Wrench 200 further includes a chain-driving mechanism 240 which includes a fluid drive mechanism 242 which includes a fluid motor 202 located inside hollow handle 204 and which has an output shaft 246 drivingly connected to the chain-driving sprocket of the workpiece-engaging mechanism and which rotates when fluid flows through the fluid motor. A fluid inlet port 250 is defined in handle 204 to be in fluid communication with a fluid source and with the fluid motor, and a fluid outlet port 252 is defined in the handle spaced from the inlet port on the handle and is fluidically connected to the fluid motor of the fluid drive mechanism whereby fluid from a fluid source flowing into the inlet port will flow through the fluid motor as the fluid flows from the inlet port to the outlet port of the fluid drive mechanism.

As discussed above, flow contact with the fluid motor causes rotation of the output shaft thereof which is transferred to the chain of wrench 200 in the manner discussed above. Rotation of the fluid motor is indicated in FIG. 12 by arrows 260. Bearings 262 and 264 are also included to stabilize the fluid motor.

It is understood that while certain forms of the present invention have been illustrated and described herein, it is not to be limited to the specific forms or arrangements of parts described and shown.

What is claimed is:

1. A wrench comprising:

a) a hollow handle having a distal end and a proximal end;

b) a workpiece-engaging head on the distal end of said handle;

c) a mechanical connector on the proximal end of said handle;

d) a workpiece-engaging mechanism located in the workpiece engaging head of said handle which includes
(1) two chain-guiding sprockets,
(2) a chain-driving sprocket, and
(3) a chain engaging the chain-driving sprocket and the two chain-guiding sprockets and having one side thereof located to engage a workpiece positioned in said workpiece-engaging head, e) a chain-driving mechanism which includes
(1) a drive shaft located inside said hollow handle and being drivingly connected at one end thereof to the chain-driving sprocket of said workpiece-engaging mechanism and having another end thereof drivingly connected to said mechanical connector for operation therewith, and
(2) a fluid drive mechanism including
(A) a housing,
(B) a fluid motor located in the housing of said fluid drive mechanism and which includes an output shaft which rotates when fluid flows through the fluid motor,
(C) a fluid inlet port defined in the housing of said fluid drive mechanism and fluidically connected to the fluid motor of said fluid drive mechanism,
(D) a fluid outlet port defined in the housing of said fluid drive mechanism spaced from the inlet port of said fluid drive mechanism and fluidically connected to the fluid motor of said fluid drive mechanism whereby fluid flowing from a fluid source into the inlet port will flow through the fluid motor as the fluid flows from the inlet port to the outlet port of said fluid drive mechanism, and
(E) a connector element on the output shaft of the fluid motor which transfers rotation of the output shaft of the fluid motor to the mechanical connector on said handle when the connector element of said fluid drive mechanism is connected to said mechanical connector on said handle to operatively transfer rotation of the output shaft of the fluid motor to the chain of said workpiece-engaging mechanism via the connection between the connector element on the output shaft of the fluid motor, the mechanical connector on said handle, the drive shaft of said chain-driving mechanism and the chain-driving sprocket of said work-piece engaging mechanism, and f) a chain-movement control mechanism on said workpiece-engaging head and which includes a ratchet on the chain-driving sprocket of said workpiece-engaging mechanism and a pawl movably mounted on said workpiece-engaging head to move between a first position spaced from engagement with the chain-driving sprocket and a second position engaging the chain-driving sprocket with rotation of the chain-driving sprocket being prevented when the pawl is in the second position.

2. The wrench defined in claim 1 further including an extension having a first connecting element on a distal end thereof which is sized and shaped to drivingly engage said mechanical connector on said handle and a second connecting element on a proximal end thereof which is sized and shaped to drivingly connect to the connector element on the output shaft of the fluid motor of said chain-driving mechanism to operatively transfer rotation of the output shaft of the fluid motor to said mechanical connector on said handle via said extension.

3. The wrench defined in claim 2 wherein said extension handle includes a flexible section.

* * * * *